United States Patent [19]

Schlesier et al.

[11] 4,160,143

[45] Jul. 3, 1979

[54] SLIDE KEY

[75] Inventors: Herbert Schlesier, Hildesheim; Alfred Scheuer, Bad Salzdetfurth, both of Fed. Rep. of Germany

[73] Assignee: Petrick GmbH Elektro-Mechanische Bauelemente, Bad Salzdetfurth, Fed. Rep. of Germany

[21] Appl. No.: 863,302

[22] Filed: Dec. 22, 1977

[30] Foreign Application Priority Data

May 20, 1977 [DE] Fed. Rep. of Germany ..... 2722813

[51] Int. Cl.[2] ..... H01H 9/20

[52] U.S. Cl. ..... 200/328; 200/153 J; 74/503

[58] Field of Search ..... 200/153 J, 318, 323, 200/324, 325, 328; 74/503, 527; 401/110

[56] References Cited

U.S. PATENT DOCUMENTS

| | | | |
|---|---|---|---|
| 2,671,354 | 3/1954 | Gods | 200/153 J X |
| 3,100,403 | 8/1963 | Döttlinger | 74/503 |
| 3,187,602 | 6/1965 | Cousins | 200/153 J X |
| 3,229,548 | 1/1966 | De Rougemont et al. | 200/153 J X |
| 3,375,340 | 3/1968 | Wright | 200/153 J X |
| 3,639,714 | 2/1972 | Fujimoto et al. | 200/153 J |
| 3,697,713 | 10/1972 | Ohkita | 200/153 J |
| 3,704,353 | 11/1972 | Halla | 200/153 J |
| 3,766,346 | 10/1973 | Alexander | 200/153 J |
| 3,914,570 | 10/1975 | Lockard | 200/153 J |
| 4,080,523 | 3/1978 | De Loisy | 200/153 J X |

FOREIGN PATENT DOCUMENTS

| | | | |
|---|---|---|---|
| 1295048 | 5/1969 | Fed. Rep. of Germany | 200/153 J |
| 1590722 | 5/1970 | Fed. Rep. of Germany | 200/153 J |
| 2116776 | 12/1971 | Fed. Rep. of Germany | 200/153 J |
| 1128363 | 1/1957 | France | 401/110 |
| 1336016 | 11/1973 | United Kingdom | 200/153 J |

*Primary Examiner*—Herbert F. Ross

*Attorney, Agent, or Firm*—Michael J. Striker

[57] ABSTRACT

A slide key is provided. The slide key comprises a housing having a socket defining an axis and having a recess at a predetermined location therein. This recess communicates with the socket. A slide bar correspondingly shaped relative to the socket is fittable therein and has a hollow depression positioned at a portion thereof corresponding to the predetermined location and being communicable with the recess. The slide bar has a projection extending radially within the depression, and an indented surface extending from the projection for a predetermined distance along the slide bar. A lock locatable within the recess has a peg extending therebelow. The peg is alternately engageable with the projection so as to lock the slide bar into a particular axial position and disengageable with the projection so as to release the slide bar.

10 Claims, 4 Drawing Figures

2
2
13
14
6
26
12
22
6
24
20
22
7
27
21
3
9a
10
8
9b
11

SLIDE KEY

BACKGROUND OF THE INVENTION

The invention relates to a slide key having a slide bar. The slide bar is displaceable between two axially spaced switch positions along an axis of displacement defined by a housing into which the slide bar fits. The slide bar is biased for displacement towards one of these positions by a spring. The slide bar has a surface which defines a somewhat heart-shaped hollow depression surrounding a projection. The projection has one rear surface facing away from and one front surface towards the spring. The housing has an interiorly located recess from which an inclined peg projects. The peg engages the rear surface of the projection to thereby lock the slide bar into a particular one of the switch positions.

Such a slide key is suitable for all switch arrangements actuable by means of a press button or key—arrangements from electrical push-button switches to fountain or ball point pens with retractable tips. There are a number of apparatuses in which a spring-biased slide bar is moved from one to another switch position by pressing the slide bar in the direction of the other position.

The locking element of the slide key consists exclusively of a cylindrical peg. This peg has two ends. One engages the projection and one passes through recess in the upper part of the housing and is therein connected to the housing. The one end projecting away from the housing is acted upon by a leaf spring. This leaf spring presses the peg against the bottom of the heart-shaped depression.

The heart-shaped hollow depression has an enclosed symmetric or asymmetric form and is so constructed that the peg is forced along the bottom of the depression always in a well-defined direction. The recess from which the peg projects is formed in such a manner that the peg can freely turn around in a plane perpendicular to the axis of displacement as the one end of the peg is passed along the bottom of the depression. When the slide bar is pressed against the spring and then released, the spring forces the slide bar away to a position in which the rear surface of the projection extending from the slide bar is engaged by the peg. This engagement locks the slide bar into a particular position. The peg is then jammed against the edges of the recess in the housing. The force of the locking is therefore transmitted from the projection of the hollow depression to the peg and from there to the edge of the recess of the housing.

The trend towards miniaturization means that the switch path of the electrical press key is constantly being shortened. The cross-section of the projection and the diameter of the peg must be reduced to provide a more compact instrument. Consequently, the interengaging parts of the locking mechanism must hold the slide bar in the locked position with a reduced cross-section of structure and material. But the present disadvantage of conventional slide keys is that either the materially weakened projection or the peg will be broken off because of the outwardly directed force of the spring—even when the springback force of the spring is reduced by a percentage corresponding to the reduction in size of the locking mechanism's interengaging parts. This problem is particularly critical with the so-called "piano key selectors" having master switches and keys with high operating forces.

SUMMARY OF THE INVENTION

An object of the invention is to improve the conventional spring-biased slide key by increasing the resistance of the locking mechanism to the outwardly directed forces of the spring.

Another object of the invention is to provide a locking mechanism having an improved structural strength relative to size.

Still another object of the invention is to dissipate at least some of the springback force of the spring against the slide bar by wedging the opposite ends of the lock between the slide bar and the housing as the peg of the lock engages the projection of the slide bar.

The inventive concept may be embodied in a slide key including, inter alia, a lock consisting of a two-armed locking lever in which each arm or opposite end can function as a stop surface with the lever also having an underside from which a peg projects. The slide key also has a slide bar having an upper surface facing the underside of the locking lever. This upper surface is provided with a notch against which is fitted a portion of one of the stop surfaces of the locking lever, and leading to the notch and inclining to the bottom of the notch, an inclined surface (a) on which lies at least a part of the underside of the locking lever, (b) into which the hollow depression extends, and (c) adjacent to which is the rear surface of the projection. The slide key additionally includes a housing having a socket and having a recess at a predetermined location therein, the recess communicating with the socket and being positioned so that at least a portion of the recess will be bounded by the inclined surface and the projection when the slide bar is inserted within the socket and is in the locking position.

The inventive slide key operates by pressing the slide bar is pressed into its locking position and then released. The slide bar slides with the rear surface of its projection being engaged by the peg of the locking lever. A moment of rotation is exerted on the locking lever—this tilts the locking lever in such a manner that one stop surface lies against the notch of the slide bar and the other opposite stop surface lies against an interior wall of the housing defining the recess. The transfer of the forces required for the locking therefore takes place by way of the notched surface of the slide bar and by way of the locking lever to the interior wall of the housing. Both the projection of the slide bar and the peg of the locking lever generally do not take part in this transfer of forces; consequently, the projection and the peg remain at least substantially free from the stresses of the spring-back force of the spring-biased slide bar. Even with very compact constructions the inventive locking is several times stronger than that of comparable conventional slide keys.

Another advantage of the inventive concept follows from the possibility of producing both the slide bar with its somewhat heart-shaped depression and the lock from a thermoplastic material having desirable sliding properties. The lock itself can be formed as one piece and can therefore be a very simple construction.

In an improved embodiment, the rear surface of the projection may be inclined in such a manner that it forms an obtuse angle with the bottom of the hollow depression, the rear surface being inclined upwardly away from the bottom of the hollow depression and in the direction of the spring. In this embodiment, the initiation of the tilting or inclining of the locking lever is improved since the rear surface itself defines the inclination of the peg and therefore the inclination of the locking lever.

Another variation of the inventive concept is to have the front surface of the projection as part of the inclined surface so that the front surface is inclined downwardly in the direction of the hollow depression and in the direction of the spring. In such an embodiment, the front surface of the projection will be the highest inclined part of the inclined surface which extends downwardly from the rear surface of the projection. This inclined surface then functions as a suitable resting surface for a portion of the underside of the locking level, particularly that front portion adjacent to the particular stop surface which is engaged by the notch. In order to provide comparably optimum conditions for the opposite stop surface, the recess of the housing may be provided with an indented or inclined surface and a notch on that wall which both defines a part of the recess and which faces the slide bar. This inclined surface is best inclined in a direction both away from the spring and upwardly and away from the slide bar. The opposite stop surface then can engage this inclined surface. This wedging of the locking lever between the notch of the slide bar and the notch of the interior of the housing provides a particularly secure transmission of springback forces to the housing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF A PREFERRED EMBODIMENT

Figure 1:
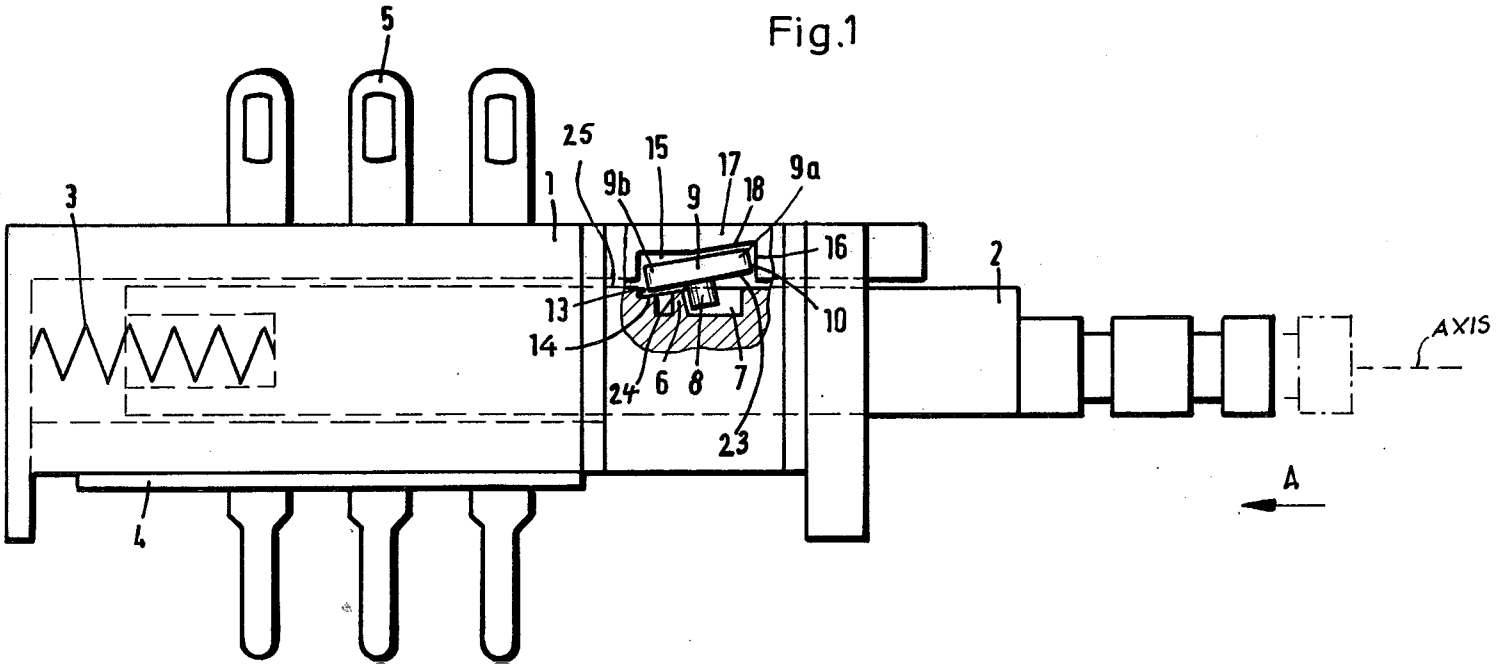
FIG. 1 is a partial cutaway of a profile of the inventive slide key.

FIG. 1 shows a slide key having a housing 1. The housing 1 has a socket defining an axis and has a recess 15 located in an interior portion of the housing in such a manner that the recess 15 communicates with the socket. The housing 1 also includes a lower cover 4 and projecting contact 5.

The slide key also includes a slide bar 2 which is correspondingly shaped relative to the socket, the outer periphery of the slide bar 2 being substantially the same in shape and dimension as the outer periphery of the socket. This slide bar 2 slides inside the socket in the direction of arrow A. The slide bar 2 has a surface 25 which faces the recess 15. A hollow depression 7 is formed in this surface 25 at a portion thereof which corresponds to the location of the recess 15 in the housing 1. When the slide bar 2 is slid inside the housing 1 to an axial position in which the slide bar 2 is to be locked, the hollow depression 7 will be in communication with the recess 15—and preferably the hollow depression 7 will be superposed under the recess 15. Additionally, a projection 6 extends radially from the bottom of the hollow depression 7 on the axially oriented slide bar 2.

Figures 2, 3, 4:
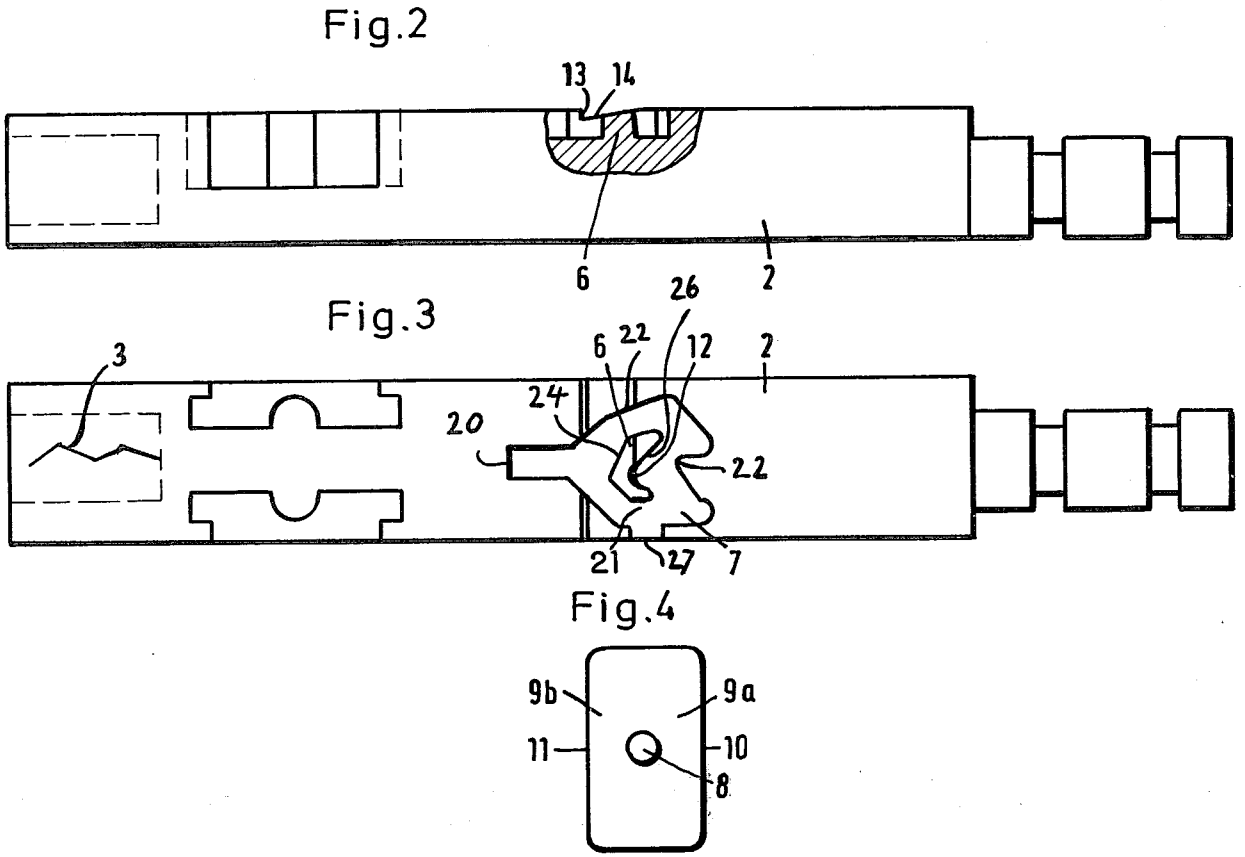
FIG. 2 is a partial cutaway of the slide bar shown in FIG. 1.
FIG. 3 is a top view of the slide bar of FIG. 2.
FIG. 4 is a view of the underside of the lock of FIG. 1.

A third major component of the slide key shown in FIG. 1 is the lock 9 which is locatable within the recess 15. The lock 9, which is shown in FIG. 4 as being a rectangular plate, has an underside 23 facing the surface 25 of the slide bar, and a peg 8 extends from the underside 23 in the direction of the surface 25. This peg 8 extends into the hollow depression 7 and can therein engage or disengage the projection 6 to thereby lock the slide bar 2 into a particular position or to unlock it from this position.

Concerning the positions of the slide bar 2, it is noted that the slide bar is axially displaceable between two switch positions. FIG. 1 shows the slide bar 2 in its contact switch position, the so-called "locking position". Even in this position, the slide bar 2 is subjected to the springback force of the return spring 3 which biases the slide bar 2 in a direction opposite that of arrow A.

The inventive concept is particularly concerned with the structure and interrelationships of those elements and formations constituting the locking mechanism for locking the spring-biased slide bar into its locking position. The locking mechanism of the invention includes the lock 9 and formations of both the slide bar 2 and the housing 1.

As shown in FIG. 3, the hollow depression 7 has a somewhat heart-shaped form; a narrow portion 20 of the hollow depression 7 is close to the spring 3 and is preferably in a groove slightly larger than the diameter of the peg 8. A widened portion 21 extends outwardly in the direction away from the spring and about the sides of the inwardly directed rim 22. An access portion 27 extends from the widened portion 21 across the surface 25 of the slide bar.

The projection 6 is arranged inside the widened part 21 of the depression 7. Projection 6 extends away from the floor of the hollow depression 7 in the direction towards the recess 15 and the lock 9. Preferably, this projection 6 is centrally located within the hollow depression, being spaced from all the sides of the walls defining the depression by a distance which is at least as great as the diameter of the peg 8. The depth of the hollow depression 7 and the length of the peg 8 are preferably arranged such that the peg 8 moves along the floor of the hollow depression 7 as the slide bar 2 is axially displaced within the socket of the housing 1. The lock 9 will remain substantially axially stationary during axial displacement of the slide bar 2 since the lock 9 fits within the recess 15 and the recess 15 is preferably only slightly longer than the length of the lock 9; the length of the recess 15 need only be so long as to permit a desirable tilting of the lock 9 as will be explained in detail below. The projection 6 has front surface 24 facing the portion 20 of the hollow depression 7 and a rear surface 26 facing away from portion 20 and towards the inwardly directed rim 22. This projection 6 is preferably an angular formation, forming a bight 12 on the rear surface 26 in which the peg 8 is restrained and held. The arms of the angular formation forming the bight 12 preferably extend in direction away from the spring 3 in order to securely keep the peg against the bight 12. As shown in the topview of FIG. 3, the projection 6 is somewhat L-shaped, but the projection could advantageously also be V-shaped or staple-shaped for example. The inwardly directed rim 22 functions to force the peg 8 in a direction towards the bight 12 of the rear surface 26.

This projection 6 is preferably inclined in a direction both away the floor of the hollow depression 7 and at least slightly in the direction of the spring 3 and the narrow portion 20 of the hollow depression 7. Therefore, the rear surface 26 of the projection 6 forms an obtuse angle with the floor of the hollow depression 7. When the peg 8 is pressed against this rear surface 26 by the force of the spring acting against the slide bar 2, the peg 8 will be inclined like the rear surface 26.

As shown in FIG. 4, the lock 9 has two stop surfaces 10, 11 each being located at one of the respective longitudinally extending sides of the rectangular lock plate 9. FIG. 1 shows stop surface 10 as being remote from spring 3 while stop surface 11 is close, but since the stop surfaces 10, 11 preferably have the same shape and dimension, they could be interchanged in position.

As the peg 8 is tilted when pressed against the rear surface 26 of the projection 6, the lock 9 is also tilted. Preferably, the peg 8 extends centrally from the planar underside 23 of the lock in a perpendicular direction and towards the surface 25 of the slide bar 2.

Since the entire lock 9 is tilted with the peg 8, it is desirable to support the tilted underside 23 of the lock 9. For this purpose, the surface 25 of the slide bar 2 is provided with an indented surface consisting of a notch 13 and an inclined surface 14 leading from the rear surface 26 in the direction of the spring 3 and to the notch 13 (see FIG. 2). The inclined surface 14 has substantially the same length as the front part 9*b* of the lock 9—front par 9*b* extending from the stop surface closest to the spring 3 to the peg 8. The inclined surface 14 extends from rear surface 26. The front surface of projection 6 forms a part of this inclined surface 14. The portion of underside 23 below this front part 9*b* rests on the inclined surface 14 as the peg 8 is pressed against the rear surface 26 of the projection 6. The stop surface closest to the spring 3 then engages the notch 13. The hollow depression 7 extends within that portion of the slide bar 2 on which the inclined surface 14 is formed.

The inclined surface 14 forms an angle with the upwardly directed rear surface 26. This angle preferably is substantially the same as the angle formed by the peg extending from the underside 23 of the lock 9. Since the peg preferably extends perpendicularly, the angle formed by the inclined surface 14 and the rear surface 26 is preferably 90°.

To improve the transmission of the springback force to the housing, the recess 15 is preferably shaped so as to securely retain the back portion 9*a* of the lock 9. The back portion 9*a* extends from peg 8 to stop surface 10. The recess 15 in the housing 1 is partially defined by a side 17 facing the surface 25 of the slide bar 2. The portion 18 of side 17 is remote from the spring 3 and has at least substantially the same length as the back portion 9*a*. This portion 18 is provided with an inclined surface 18. Preferably, the angle of inclination of the inclined surface 18 is at least substantially the same as that of inclined surface 14 of the slide bar 2. This correspondence improves the security of the retention of the lock 9. At the remote end of inclined surface 18 is a notch 16 against which the stop surface 10 of the lock 9 is pressed.

The inclination of the inclined surface 14 and the inclined surface 18 preferably correspond so that these surfaces are inclined in a direction parallel to each other.

It will be understood that each of the elements described above, or two or more together, may also find a useful application in other types of a slide keyp differing from the types described above.

While the invention has been illustrated and described as embodied in constructions, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A slide key comprising, in combination, a housing having a socket defining an axis and having a recess at a predetermined location therein, the recess communicating with the socket; a slide bar correspondingly shaped relative to the socket so as to be fittable therein and having a hollow depression positioned at a portion thereof corresponding to said predetermined location and being communicable with the recess, said slide bar having a projection having a rear surface and extending radially within the depression and an inclined surface extending from said projection for a predetermined distance along said slide bar, said slide bar further having a notch into which said inclined surface extends and which is a remote end of said inclined surface relative to said projection; a spring in said housing projecting into the socket along the axis, whereby said slide bar is spring-biased in an axial direction outwardly of the socket; and a lock locatable within the recess and having a peg extending therebelow, said peg being alternately engageable with said rear surface of said projection so as to lock said slide bar into a particular axial position and disengageable from said rear surface of said projection so as to release said slide bar, said lock having a front and a rear stop surface and a front portion extending from said peg to said front stop surface, said front stop surface of said lock engaging said notch as said front portion lies against said inclined surface and said peg of said lock engages said rear surface of said projection of said slide bar.

2. The slide key of claim 1, said lock being loosely fittable within the recess, the recess being sufficiently large that said lock is accommodated in a tilted position in which a portion thereof lies against said indented surface.

3. The slide key of claim 1, said projection being substantially centrally located within the hollow depression.

4. A slide key comprising, in combination, a housing having a socket defining an axis and having a recess at a predetermined location therein, the recess communicating with the socket; a slide bar correspondingly shaped relative to the socket so as to be fittable therein and having a hollow depression positioned at a portion thereof corresponding to said predetermined location and being communicable with the recess, said slide bar having a projection having a rear surface and extending radially within the depression and an inclined surface extending from said projection for a predetermined distance along said slide bar; a spring in said housing projecting into said socket along said axis, whereby said slide bar is spring-biased in an axial direction outwardly of said socket, said rear surface of said projection being inclined towards said recess of said socket of said housing and towards said spring; and a lock locatable within the recess and having a peg extending therebelow, said beg being alternately engageable with said rear surface of said projection so as to lock said slide bar into a particular axial position and disengageable from said rear surface of said projection so as to release said slide bar.

5. The slide key of claim 4, said first-mentioned inclined surface of said slide bar surface extending from said rear surface in direction towards said spring.

6. The slide key of claim 4, said lock having a front and a rear stop surface, a front portion extending from said peg to said front stop surface and having a length substantially the same as said predetermined distance of said first-mentioned inclined surface of said slide bar.

7. The slide key of claim 6, said peg being substantially perpendicular to said lock; said first-mentioned inclined surface of said slide bar forming an angle of about 90° with said rear surface of said projection.

8. The slide key of claim 7, further comprising a notch into which said indented surface extends, said notch being a remote end of said indented surface relative to said projection, whereby said front stop surface of said lock engages said notch as said front portion lies against said indented surface.

9. The projection of claim 4, said projection being an angular formation with an acute bight on said rear surface.

10. A slide key comprising, in combination, a housing having a socket defining an axis and having a recess at a predetermined location therein, the recess communicating with the socket; a slide bar correspondingly shaped relative to the socket so as to be fittable therein and having a hollow depression positioned at a portion thereof corresponding to said predetermined location and being communicable with the recess, said slide bar having a projection extending radially within the depression and an inclined surface extending from said projection for a predetermined distance along said slide bar, said housing including an interior wall defining a portion of the recess and being superposable over the hollow depression, said wall having an inclined surface extending in a direction opposite that of said inclined surface of said slide bar; and a lock locatable within the recess and having a peg extending therebelow, said peg being alternately engageable with said projection so as to lock said slide bar into a particular axial position and disengageable with said projection so as to release said slide bar.

* * * * *